US006293064B1

(12) United States Patent
Larson

(10) Patent No.: US 6,293,064 B1
(45) Date of Patent: Sep. 25, 2001

(54) MOISTURE MANAGEMENT SYSTEM

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 09/375,729

(22) Filed: Aug. 17, 1999

(51) Int. Cl.[7] ..... E04B 1/70
(52) U.S. Cl. ..... 52/302.1; 52/62; 52/209
(58) Field of Search ..... 52/209, 204.5, 52/58, 62, 734.1, 720.1, 302.1

(56) References Cited

U.S. PATENT DOCUMENTS 3,239,977 * 3/1966 Shore ..... 52/209 X
3,383,815 * 5/1968 Smith, Jr. ..... 52/209
3,432,976 * 3/1969 Berg ..... 52/62
4,967,507 * 11/1990 Visnic et al. ..... 52/209 X
5,836,135 * 11/1998 Hagan et al. ..... 52/58 X
5,937,600 * 8/1999 Larson ..... 52/62 X
5,970,671 * 8/1999 Bifano et al. ..... 52/209 X

* cited by examiner

*Primary Examiner*—Peter M. Cuomo
*Assistant Examiner*—Stephen Vu

(57) ABSTRACT

A moisture management system for installation over doors and windows in buildings that included exterior, stucco-covered, curtain walls comprising an integrally formed, three sided, elongated track including a base having weep holes therein, an upright front wall and an upright rear wall at opposing elongated edges of the base, and, extending angularly downward from the outside of the base, and integrally formed therewith, a drip plate that permits ready drainage of water entering the moisture management system through the weep holes in the base. Elongated striations in the front faces of both the front and rear upright walls as well as holes in the front upright wall provide adherence of sealants and adhesives used in the installation process.

6 Claims, 3 Drawing Sheets

MOISTURE MANAGEMENT SYSTEM

FIELD OF THE INVENTION

The present invention relates to moisture management systems for use over windows, doors and other building openings on buildings where so-called stucco covered, curtain type foamed siding is applied to the exterior of a building. Such moisture management systems inhibit the infiltration of water into the building at the top of such openings by providing a path for the potentially infiltrating water to take away from the surface of the building. The moisture management system described herein is also useful at the base of such exteriorly applied foamed siding to prevent water infiltration.

BACKGROUND OF THE INVENTION

The infiltration of water into buildings and other structures particularly at the top of windows, doors etc as well at the base of so-called stucco-covered, curtain type, foamed siding applied to the exterior of buildings is a constant problem in both new and retrofit construction.

The term curtain wall refers to a type of building construction in which an exterior non-load-bearing wall is supported in front of the structural frame like a curtain. Such wall structures, in some instances can be exposed to rain driven by winds; as high as 90 miles per hour in certain areas, and consequently are vulnerable to infiltration of wind driven rain as well as insufficient drainage of accumulated water from the area between the exterior curtain wall and the interior supporting shell of the wall construction.

Particularly vulnerable to infiltration of rainwater in this fashion are the areas over doors and windows and the lower extremity of the curtain wall where it meets the sill or foundation of the building.

The problem of infiltrated water can become critical where the wall area includes large window and or door openings and is often aggravated where water entering the wall cavity accumulates sufficiently to cause leakage into the interior of the building with resulting water damage. In some cases, water entering the wall cavity between the interior load bearing wall and the exterior curtain wall at window and door openings does not drain to the exterior of the building, but soaks through the wall portions causing structural damage and discoloration of the visible exterior portions of the wall.

Consequently, numerous designs have been proposed for moisture management systems and drip edges that either inhibit such infiltration and/or provide a means for conducting infiltrating water away from the opening in a safe and non-destructive manner.

U.S. Pat. No. 3,568,391 to Conway issued Mar. 9, 1971 describes a casing bead for stucco-covered curtain wall construction employing a joint including an elongate L-shaped casing bead and an elongate generally wing-shaped drainage cap member. The two joint components form a horizontally-disposed, structurally yielding joint between outer covering curtain wall sections that provides ventilation and water drainage between adjacent curtain wall panel sections.

U.S. Pat. No. 5,003,743 to Bifano et al, issued Apr. 2, 1991 describes another Proposed track device for the installation of curtain wall type siding on structures that includes a flange arrangement designed to inhibit the infiltration of water, but no means to conduct infiltrated water away from the mounting device.

Vinyl Corporation of Miami, Fla. currently supplies a moisture management system for installation over doors and windows as depicted in attached FIG. 1. This moisture management system comprises a generally U-shaped channel having a base including weep holes, front and rear upstanding walls, and a drip plate below the weep holes. The drip plate comprises a separate member welded parallel to the bottom of the base and having a cutout or recess below the weep holes in the base for removal of water passing through the weep holes. As will be described in detail below in connection with the description of the moisture management system of the current invention, this structure is inherently inferior to the unitary moisture management system of the present invention, and lacks certain features which render its installation inferior and less secure and while also providing for less drainage capability.

OBJECT OF THE INVENTION

It is therefore an object of the present invention to provide an improved moisture management system for installation over doors and windows on buildings utilizing a stucco-covered, curtain wall construction that demonstrates improved resistance to water infiltration, better drainage characteristics, and improved installation security.

SUMMARY OF THE INVENTION

According to the present invention, there is provided an improved moisture management system for installation over doors and windows in buildings that included exterior, stucco-covered, curtain walls comprising an integrally formed, three sided, elongated track including a base having weep holes therein, an upright front wall and an upright rear wall at opposing elongated edges of the base, and, extending angularly downward from the outside of the base, and integrally formed therewith, a drip plate that permits ready drainage of water entering the moisture management system through the weep holes in the base. Elongated striations in the front faces of both the front and rear upright walls as well as holes in the front upright wall provide improved adherence of sealants and adhesives used in the installation process.

DESCRIPTION OF THE INVENTION

The invention described herein is similar to that described in U.S. patent application Ser. No. 08/807,655 filed Feb. 27, 1997 which application is hereby referred to and incorporated by reference herein.

Figure 2:
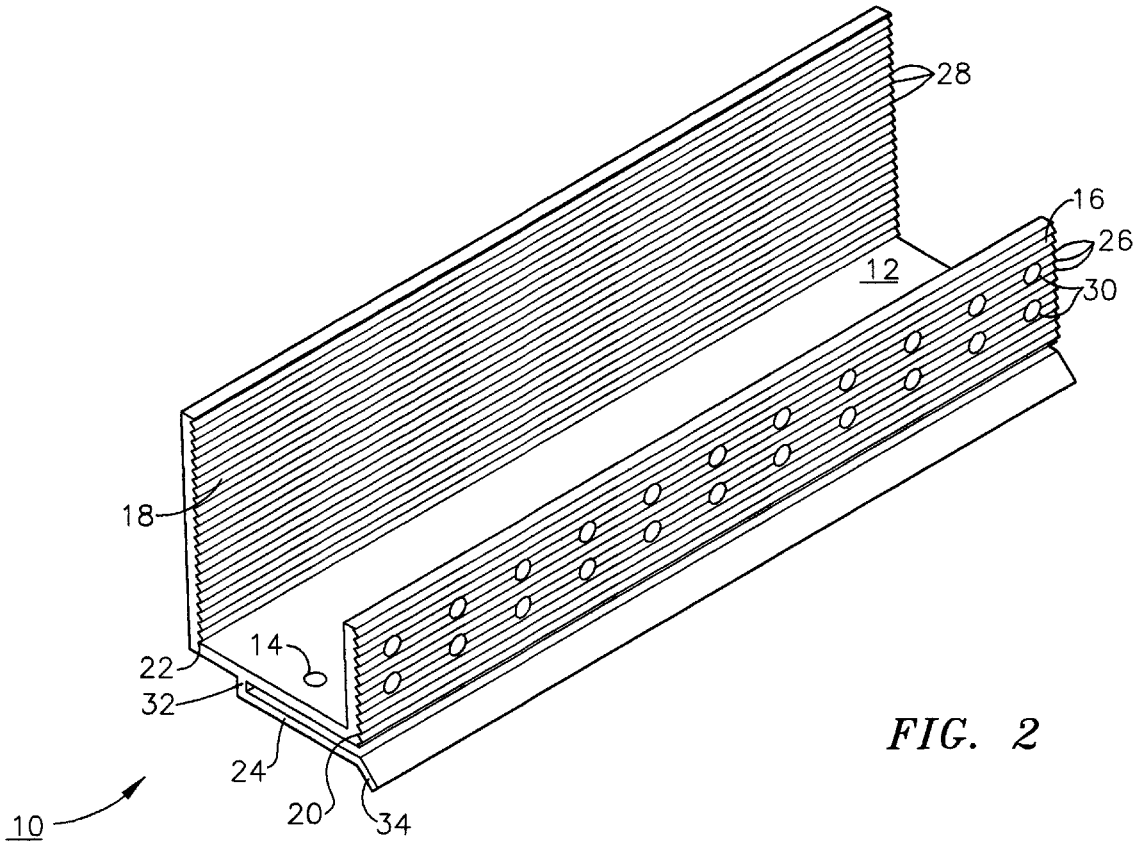
FIG. 2 is a perspective view of the improved moisture management system of the present invention.
Figure 3:
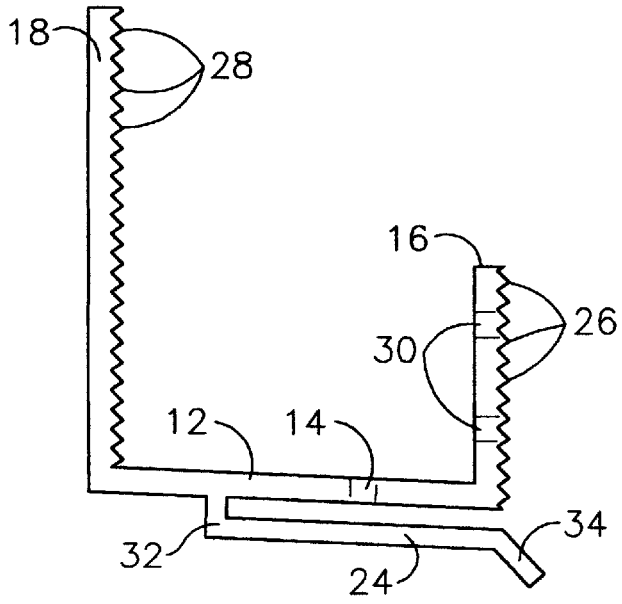
FIG. 3 is a cross-sectional view of the moisture management system of the present invention.

As shown in FIG. 2, the moisture management system 10 of the present invention comprises an elongated, generally U-shaped, channel having a base 12 including weep holes 14 therein, an upstanding front wall 16 and an upstanding rear wall 18 extending in parallel relationship from elongated edges 20 and 22 of base 12, and drip plate 24 integrally formed with base 12 and extending angularly downward therefrom. The front of both upstanding front wall 16 and rear wall 18 include parallel striations 26 and 28 across their entire length. Front upstanding wall 16 further includes holes 30 therein. The purpose and utility of these various features will be explained in greater detail in connection with the manner of installation of moisture management system 10.

Of particular interest and advantage in the present invention is drip plate 24. Drip plate 24 is integrally formed with base 12 and connected thereto by leg 32 that is formed in the extrusion process preferably used to fabricate moisture management system 10. Drip plate 24 is designed and manufactured to extend from leg 32 at a downward angle from base 12 so as to provide an enhanced pathway for removal of water that seeps through weep holes 14 that run along the entire length of the front portion of base 12 and in registration with drip plate 24. Although no particular angle is critical to the successful practice of the present invention, a downward angle of greater than about 4° from the plane of base 12 is preferred. Tip 34 of drip plate 24 extends beyond front edge 20 of upstanding front wall 16 and is also further angled downward from drip plate 24 to further assure positive removal of water escaping from drip plate 24.

Figure 4:
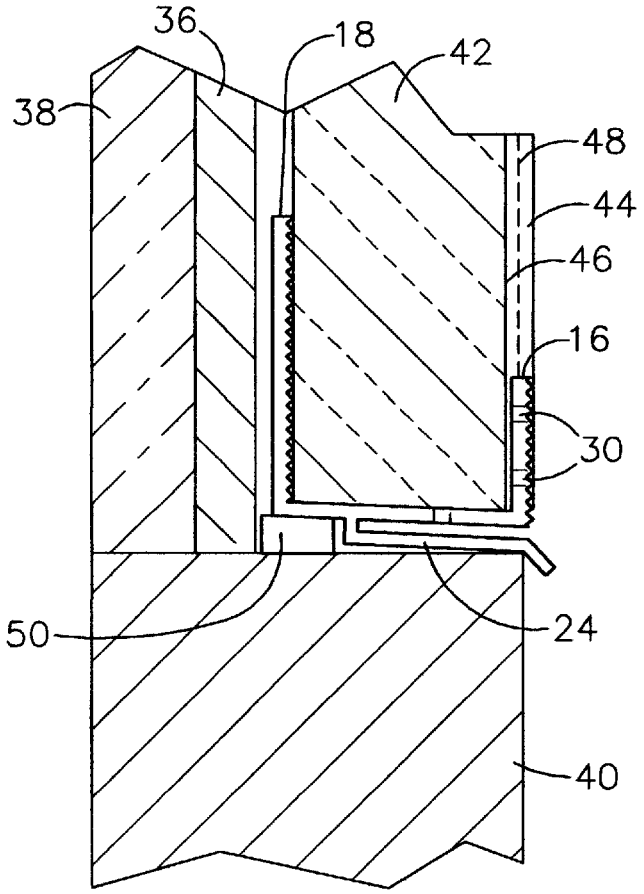
FIG. 4 is a cross-sectional of the moisture management system of the present invention in its installed configuration.

The relative location of leg 32 extending from the bottom of base 12 is not of critical importance, however, location of leg 32 at a point near the midpoint of the width of base 12 provides optimum positioning on underlying window or door 40 as shown in FIG. 4. Additionally this positioning allows for the application of backer rod and caulk 40 as shown in FIG. 4, thereby providing an additional measure of protection against water infiltration at any point below moisture management system 10 in the case of a wind driven rain.

Although moisture management system 10 may be fabricated from any number of materials and using a broad variety of fabrication processes, it is preferred that moisture management system 10 be fabricated from a polymeric material such as PVC using an extrusion process for reasons of cost and simplicity of fabrication.

Installation of moisture management system 10 is accomplished as shown in FIG. 4. Rear upstanding wall 18 is nailed or otherwise attached to sheathing 36 attached to stud 38 over window 40. A section of backer rod and caulking 50 is inserted into the recess formed by leg 32 in contact with the top of window 40 prior to nailing. Foam panel 42 is then inserted into the channel of moisture management system 10. Striations 28 provide for a firm and secure grip by moisture management system 10 on foam panel 42. Modified cement 44 is then placed over face 46 of foam panel 42 and fiberglass mesh 48 embedded in cement 44. The presence of holes 30 in and striations 26 on front upstanding wall 16 permit cement 44 to penetrate front upstanding wall 16 and to adhere more effectively thereto thereby providing a more secure structure. Tape or some other protection is preferably applied over the face of drip plate 24 during the installation operation to insure that drip plate 24 does not become plugged during the cementing and finishing operations.

Figure 1:
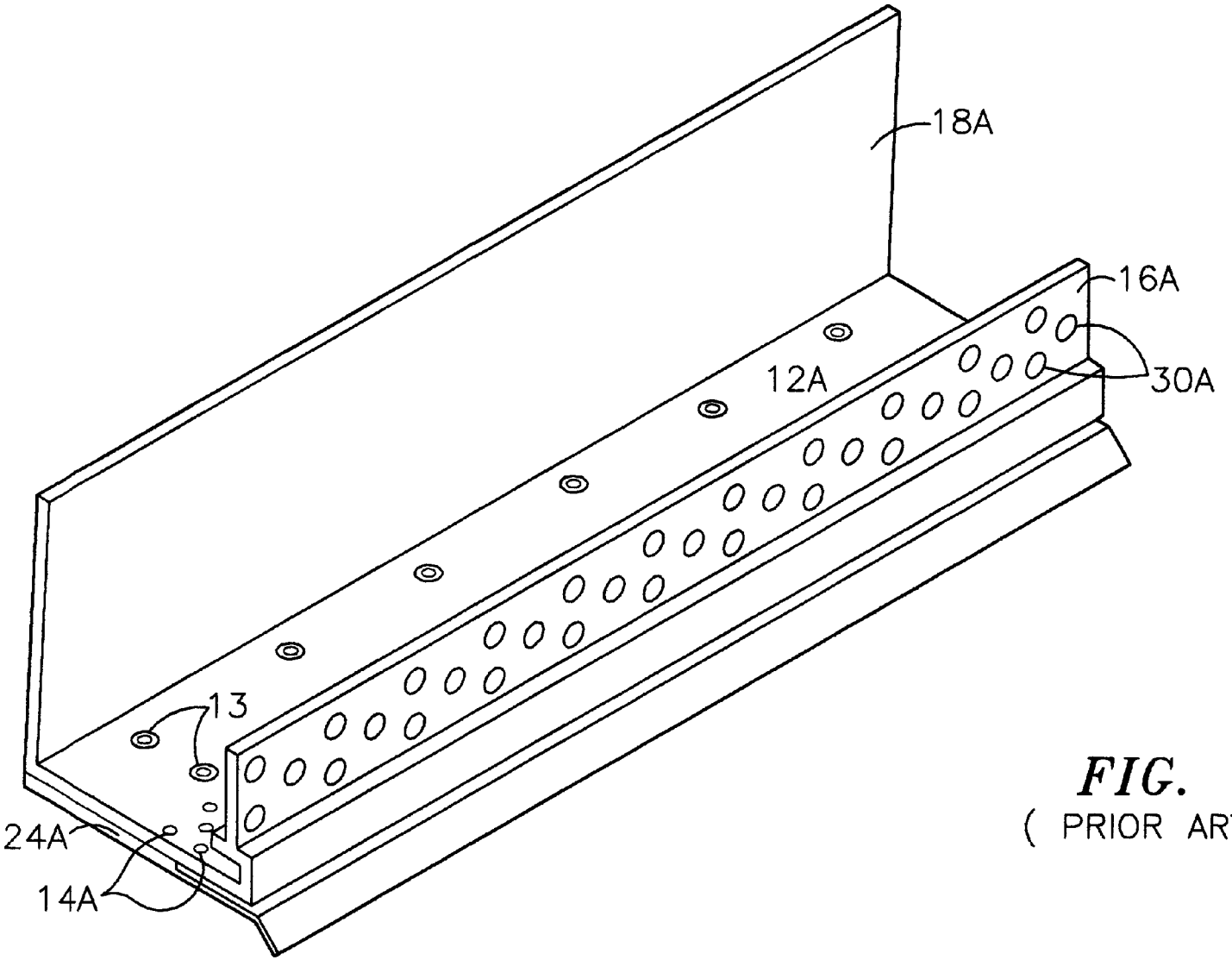
FIG. 1 ( PRIOR ART )
FIG. 1 is a perspective view of a moisture management system of the prior art.

As will be apparent to the skilled artisan, the integral design of the present invention provides certain inherent advantages over the prior art design depicted in FIG. 1 wherein like parts have similar numbers but with an A designation. First, drip plate 24A being a separate part spot welded to base 12 at locations provides pathways for water intrusion between base 12A and drip plate 24A. Rivets are shown at 13.

Secondly, since drip plate 12A is welded parallel to base 12A there is no positive angle to encourage flow of water permeating weep holes 14A. In fact, if the top of the window or door to which moisture management system 10A is applied is tilted back even slightly, water will be able to infiltrate into the interior of the building through the passage at the interface of drip plate 24A and base 12A which is not fully sealed, as is the case with the integral moisture management system of the present invention.

Finally, the absence of striations 26 and 28 on the faces of front and rear upstanding walls 16A and 18A does not allow for the same secure level of adhesion as if these elements were present.

As will be apparent to the skilled artisan, a number of variations and modifications can be made to the structure described above without departing from the spirit and scope of the present invention. All such modifications and changes are clearly contemplated as being within the scope of the appended claims.

What is claimed is:

1. A moisture management system for installation over doors and windows in buildings that included exterior curtain walls, said system comprising:

A) an integrally formed, three sided, elongated channel including:

I) a base having weep holes therein and an underside;

II) an upstanding front wall and an upstanding real wall at opposing elongated edges of the base; and III) extending angularly downward from the base, and integrally formed therewith, a drip plate integrally connected by an integral leg to said underside of said base that permits ready drainage of water entering the moisture management system through the weep holes in the base.

2. The moisture management system of claim 1 wherein the upstanding front and rear walls each have a front face and including parallel longitudinal striations across the respective faces.

3. The moisture management system of claim 2 further including holes in said upstanding front wall.

4. The moisture management system of claim 2 further including holes in said upstanding front wall.

5. The moisture management system of claim 1 wherein the drip plate includes a tip portion extending beyond the front edge of the base, said tip portion extending angularly downward from said drip plate.

6. The moisture management system of claim 5 wherein the upstanding front and rear walls each have a front face and including parallel longitudinal striations across the respective faces.

* * * * *